US005193706A

United States Patent [19]

Hanna et al.

[11] Patent Number: 5,193,706

[45] Date of Patent: Mar. 16, 1993

[54] TOOLBOX

[75] Inventors: Thomas E. Hanna; Keith E. Brightbill, both of Wooster, Ohio

[73] Assignee: Rubbermaid Incorporated, Wooster, Ohio

[21] Appl. No.: 471,285

[22] Filed: Jan. 26, 1990

[51] Int. Cl.[5] ..... B65D 45/16

[52] U.S. Cl. ..... 220/324; 220/315; 220/334; 220/761; 220/771; 292/113; 292/DIG. 38; 292/DIG. 39; 312/902

[58] Field of Search ..... 220/94 R, 315, 324, 220/334, 335, 337, 338, 342, 343, 344, 761, 771; 292/113, DIG. 38, DIG. 49; 150/155; 190/115; 312/244, DIG. 33

[56] References Cited

U.S. PATENT DOCUMENTS

| | | | |
|---|---|---|---|
| D. 158,368 | 5/1950 | Felts et al. | D58/12.6 |
| D. 220,556 | 4/1971 | Evans | D87/1 |
| D. 232,129 | 7/1974 | Evans | D87/1 R |
| D. 237,121 | 10/1975 | Metzner | D87/1 |
| D. 246,071 | 10/1977 | Landell et al. | D87/1 R |
| D. 246,139 | 10/1977 | Landell et al. | D87/1 R |
| D. 246,548 | 11/1977 | Uyeda | D87/1 R |
| 2,893,771 | 7/1959 | Claud-Mantle et al. | 292/113 |
| 3,181,905 | 5/1965 | Bisbing | 292/109 |
| 3,346,733 | 10/1967 | Woolworth | 240/6.4 |
| 3,362,561 | 1/1968 | Bakos | 220/343 X |
| 3,466,076 | 9/1969 | Bisbing | 292/109 |
| 3,490,805 | 1/1970 | Di Pierro et al. | 292/258 |
| 3,606,511 | 9/1971 | Henning et al. | 312/266 |
| 3,628,843 | 12/1971 | Wynne et al. | 312/294 |
| 3,747,796 | 7/1973 | Kneier et al. | 220/29 |
| 3,822,905 | 7/1974 | Bell | 292/87 |
| 3,985,409 | 10/1976 | Kneier | 312/271 |
| 4,023,840 | 5/1977 | Souza et al. | 292/113 |
| 4,161,261 | 7/1979 | Frates | 220/337 |
| 4,244,612 | 1/1981 | Schurman | 292/249 |
| 4,261,078 | 4/1981 | Edwards et al. | 16/126 |
| 4,474,291 | 10/1984 | Fortson | 206/315.11 |
| 4,501,378 | 2/1985 | Berfield | 220/324 |
| 4,502,715 | 3/1985 | Lundblade | 292/78 |
| 4,540,206 | 9/1985 | Frame et al. | 292/66 |
| 4,544,050 | 10/1985 | Seynhaeve | 190/115 |
| 4,662,515 | 5/1987 | Newby, Sr. | 206/349 |
| 4,665,596 | 5/1987 | Green | 24/662 |
| 4,705,308 | 11/1987 | Bisbing | 292/108 |
| 4,729,474 | 3/1988 | Lanius et al. | 206/315.11 |
| 4,739,577 | 4/1988 | Lanius | 43/54.1 |
| 4,775,199 | 10/1988 | Lanius et al. | 312/220 |
| 4,828,298 | 5/1989 | Bisbing | 292/113 |
| 5,012,553 | 5/1991 | Hardigg et al. | 220/94 R |

FOREIGN PATENT DOCUMENTS

| | | |
|---|---|---|
| 2565205 | 12/1985 | France . |
| 603995 | 6/1948 | United Kingdom . |

OTHER PUBLICATIONS

Plano catalog, 1989, Plano Molding Company, 431 E. South Street, P.O. Box 189, Plano, Ill. 60545-0189.

Flambeau catalog, 1989, Flambeau Products Corporation, Hardware Division, 15981 Valplast Rd. Middlefield, Ohio 44062.

Contico catalog, 1989, Contico, St. Louis Mo. 63132.

Disston brochure, 1989, The Disston Company, P.O. Box 3000, Danville, Va. 24543.

MTM Tool Gard brochure, MTM Molded Products Company, P.O. Box 14117, Dayton, Ohio 45414.

GSC brochure, GSC Technology Corporation, Champlain, N.Y.

Ecko catalog, 1989, Ecko Specialty Products, 165 W. Chicago Avenue, Chicago, Ill. 60610.

*Primary Examiner*—Allan N. Shoap
*Assistant Examiner*—Nova Stucker
*Attorney, Agent, or Firm*—Renner, Kenner, Greive, Bobak, Taylor & Weber

[57] ABSTRACT

A utility box (10) includes a base portion (13) and a cover portion (11) attached thereto as by hinges (12). The cover portion (11) includes a downwardly directed skirt (17) and the upper end of the base portion (13) is provided with a complementary skirt (27). At least one latch assembly (28) is recessed within the complementary skirts (17, 27) and includes a latch handle (30) having an outer contour matching the complementary skirts (17, 27). A lock receiving area (52) is also recessed within the complementary skirts (17, 27). Side handles (62) are formed in the base portion (13) and recessed beneath the cover portion (11). A top handle (66) is provided within a recess (67) in the top surface (14) of cover portion (11).

22 Claims, 3 Drawing Sheets

TOOLBOX

TECHNICAL FIELD

This invention relates to a utility box such as a box for holding and storing tools, fishing tackle, or the like. More particularly, this invention relates to a box in which all latches, handles, locks and the like are flush with the continuous outer surface of the box.

BACKGROUND ART

Most utility boxes have a cover that is hingedly attached to a base with latches being provided to maintain the cover closed on the base. These boxes also usually have a handle extending upwardly from the top of the cover or two handles extending outwardly from the sides of the base so that the box can be easily transported. Many times such boxes are also provided with complementary lock receiving areas on the cover and the base so that when the cover is closed on the base the box can be locked, as by a conventional padlock.

For ease of construction and assembly, the above described latches, handles and lock receiving areas are not flush with the exterior profile of the mating cover and base, that is, they stick out or otherwise protrude outwardly from that outer profile. As such, they are susceptible to being damaged particularly when the box is stored in a confined area. In addition, the protruding latches can be snagged or otherwise engaged by an external object either causing damage to the external object or an inadvertent opening of the box with the resulting possible spillage of the contents of the box.

When utility boxes are provided with side handles, these too usually extend outwardly making storage of the box in a confined area relatively impossible. In those boxes where attempts have been made to recess the side handles so that they do not take up valuable storage space, valuable space inside the box is used up by these recessed handles such that the capacity of the box to store tools or the like is diminished.

Regarding the handle usually provided on the top of the cover of most utility boxes, quite often it too is of the type which permanently extends upwardly from the box. This configuration has the advantage not only that the box can be easily and quickly grasped, but also that the handle can be provided with a soft grip, such as a sponge rubber type of grip, for the comfortable transporting of the box. Such protruding handles have the disadvantage, however, of prohibiting the stacking of similar boxes or the placement of any article, for that matter, on top of the box.

In response to this problem, some utility boxes have been designed with a handle that can be recessed within the top of the cover when the box is being stored, and when the box is to be transported, the handle can be swung from its recessed position to a position extending upwardly from the cover. While solving the storage problem of the other types of handles which permanently extend upwardly from the box, these recessed handles do not allow for quick and easy grasping nor can they be padded with a soft grip because the padding would extend above the top of the cover when the handle is in the stowed position thereby defeating the purpose of a totally recessed handle.

DISCLOSURE OF THE INVENTION

It is thus a primary object of the present invention to provide a utility box, such as a toolbox, with all items such as latches, lock receiving areas and the like being recessed within the mating cover and base so that the external surface of the mating cover and base is smooth and unobstructed.

It is another object of the present invention to provide a toolbox, as above, in which all handles are recessed within the outer surface thereof so that the outer surface is smooth and unobstructed.

It is a further object of the present invention to provide a toolbox, as above, which is provided with recessed side handles without diminishing the capacity of the toolbox.

It is an additional object of the present invention to provide a toolbox, as above, which is provided with a cushioned handle which can be stored recessed within the cover of the toolbox.

These and other objects of the present invention, as well as the advantages thereof over existing prior art forms, which will become apparent from the description to follow, are accomplished by the means hereinafter described and claimed.

In general, a utility box according to the concepts of the present invention includes a base member forming an open container and a cover member having a top surface and being hingedly attached to the base member. The base and cover members are provided with complementary mating surfaces and a latch mechanism is recessed within and flush with the mating surfaces. A lock receiving area is also recessed within the mating surfaces. Recessed side handles are formed in the base member under the cover member. A top handle can be provided in a recess in the top surface of the cover member. Thus, all components are either flush with or recessed within the outer contour of the utility box.

A preferred exemplary toolbox incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
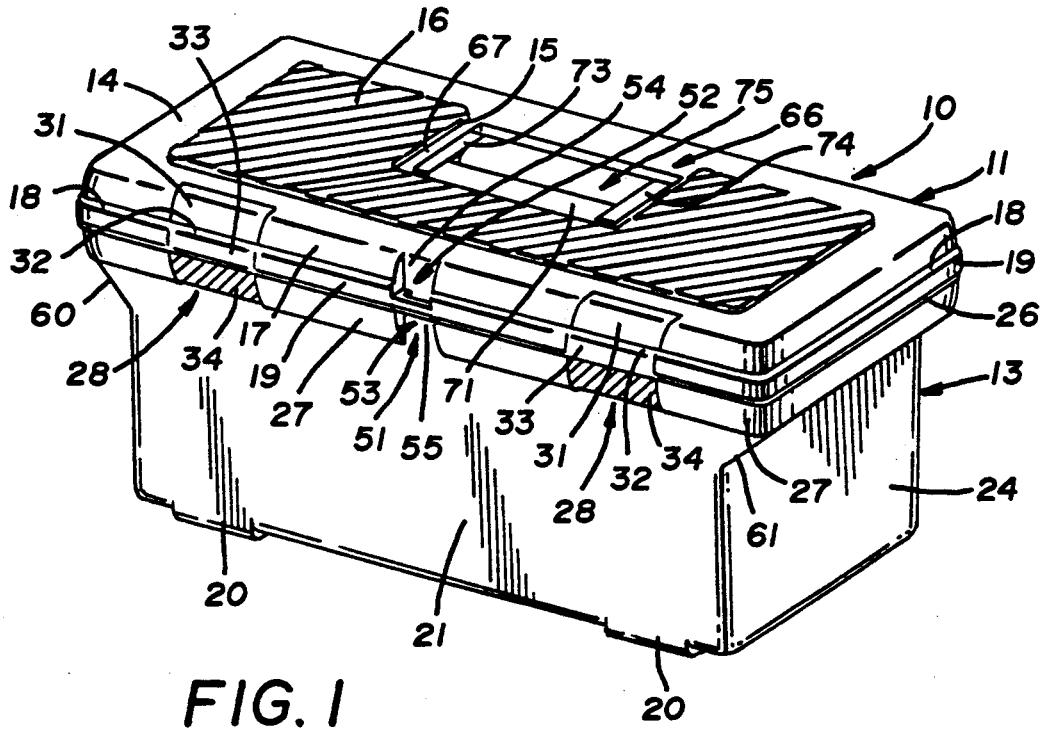
FIG. 1 is a perspective view of a toolbox according to the concepts of the present invention.

A toolbox according to the concept of the present invention is indicated generally by the numeral 10 in the drawings and includes a cover portion, indicated generally by the numeral 11, which is attached, as by conventional hinges 12, to a base or container portion generally indicated by the numeral 13.

Cover portion 11 includes a generally planar top surface 14 which is shown as having a U-shaped embellishing platform or raised area 15 adorned with diagonal grooves 16. An arcuate skirt 17 extends downwardly from all four edges of top 14. On each side except the back in the area of hinges 12, this cover skirt 17 terminates on its lower end as an outwardly extending ledge 18 which terminates at its outer end as a downturned lip 19.

Base portion 13 rests on feet 20 and includes a front wall 21, rear wall 22, and sidewalls 23 and 24 which together define a container with an open top. Such open top is defined by a rim 25 seen, for example, in FIGS. 5 and 6, which is formed at the top of walls 21, 23 and 24. A peripheral ledge 26 extends outwardly from walls 21, 23 and 24 just below rim 25 to the same outward extent as the outer dimension of downturned lip 19 of cover 11. Ledge 18 of cover 11 thereby rests on rim 25 and the lower portion of downturned lip 19 of cover 11 is in close proximity to ledge 26 of base portion 13 when the cover 11 of toolbox 10 is closed.

The upper portion of each of walls 21, 23 and 24, at a point just below ledge 26, is configured as an arcuate skirt 27 to complement and generally match skirt 17 of cover 11. As such, at the point of mating engagement of cover 11 and base 13, a continuous surface consisting of skirt 17, downturned lip 19 and skirt 27 is formed thereby defining the outside contour of that portion of toolbox 10 as two complementary mating arcuate surfaces separated by the lip 19 portion of cover 10 which extends slightly outwardly from the arcuate surfaces.

The front surface of toolbox 10 is provided with two latch assemblies indicated generally by the numeral 28. It should be appreciated, however, that dependent on the size of a particular toolbox 10, only one latch might be necessary or, conversely, more than two latch assemblies may be employed without departing from the spirit of this invention. As shown, each latch assembly is located in a recess 29 formed in the front contour of toolbox 10, that is, formed in arcuate skirts 17 and 27 as well as lip 29.

The manner in which latch assemblies 28 operate within recess 29 will now be described in detail with specific reference to FIG. 4. Each latch assembly 28 includes a latch handle generally indicated by the numeral 30. As shown, each latch handle 30 has an outer contour matching the outer contour of that area of toolbox 10 just described. Thus, the outer contour of each latch handle 30 includes an upper arcuate surface 31 matching the contour of arcuate surface 17 of cover 11. The lower end of arcuate surface 31 terminates as a step 32 matching the ledge 18 of cover 10. A front surface 33 extends downwardly from step 32 and matches the configuration of lip 19 of cover 10. A second arcuate surface 34 extends downwardly from front surface 33 which matches the configuration of arcuate skirt 27 of base portion 13. As shown, at least a portion of second arcuate surface 34 may be adorned with diagonal grooves 35 to aesthetically match grooves 16 in raised area 15 of top surface 14 and also to provide a gripping surface for each latch handle 30. It should thus be evident that latch handle 30, in its closed position, is recessed within recess 29 and has an outer contour which matches and is flush with the adjacent components of toolbox 10.

The top of each latch handle 30, that is, at the upper end of arcuate surface 31, includes a planar surface 36 flush with cover top surface 14. Planar surface 36 terminates at its inward end as a downwardly directed locking lug 37.

Figure 4:
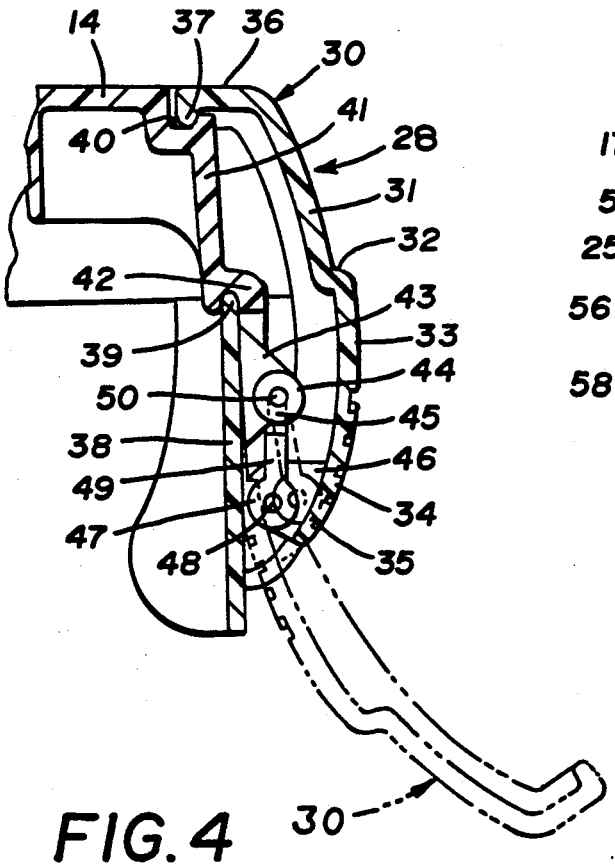
FIG. 4 is a sectional view taken substantially along line 4—4 of FIG. 2 and showing the details of a latch mechanism.

As shown in FIG. 4, the inner edge of latch assembly recess 29 is defined by a wall 38 formed in base portion 13 which has a rim 39 at the upper end thereof. The portion of recess 29 formed by cover 11 includes a locking notch 40 adjacent to top surface 14. A generally vertical wall 41 extends downwardly from notch 40 and terminates as a lip 42 which engages rim 39 of wall 38.

A trunnion plate 43 extends outwardly from wall 38 within recess 29 and carries a tubular bearing knuckle 44 which is provided with a longitudinally extending key hole 45 at the bottom thereof. The lower end of each latch handle 30 is provided with trunnions 46 (one shown in FIG. 4) which support a tubular bearing knuckle 47 which extends the entire width of handle 30 and which carries a pivot pin 48 which is supported by base portion 13. A link arm 49 extends upwardly from knuckle 47 on each side of knuckle 44 and carries a pivot pin 50 near the top thereof. Pivot pin 50 is inserted through key hole 45 to assemble latch assembly 28.

Latch assembly 28 operates as a rather conventional over-the-center latching system. When in the open position, handle 30 generally hangs downwardly as shown in the chain line position of FIG. 4 with knuckle 47 and link arm 49 being in the solid line position shown in FIG. 4. When handle 30 is moved upwardly toward its closed position, it pivots on pins 48 and 50, and locking lug 37 can thereby be rather loosely positioned above locking notch 40. At this point in time, knuckle 47 and link arm 49 are in the chain line position shown in FIG. 4. Then, upon a slight downward movement of handle 30, link arm 49 swings knuckle 47 past the pivot point of pin 50 and locking lug 37 firmly engages locking notch 40 as shown in the solid line position in FIG. 4. To open the latch, one merely needs to lift handle 30 slightly which rotates link arm 49 and knuckle 47 to the chain line position in FIG. 4 and then swing handle 30 to the chain line position.

Figure 5:
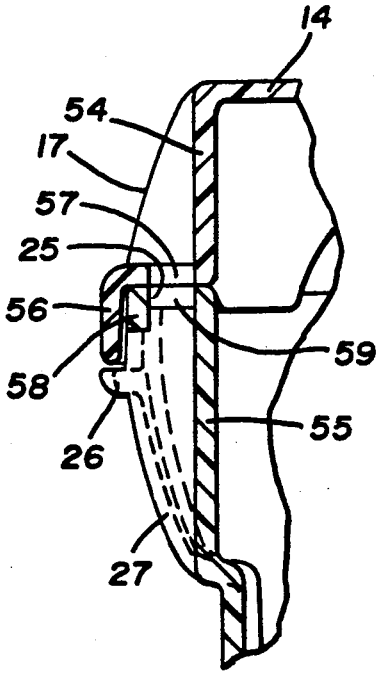
FIG. 5 is a sectional view taken substantially along line 5—5 of FIG. 2 and showing the details of a lock receiving area.
Figure 6:
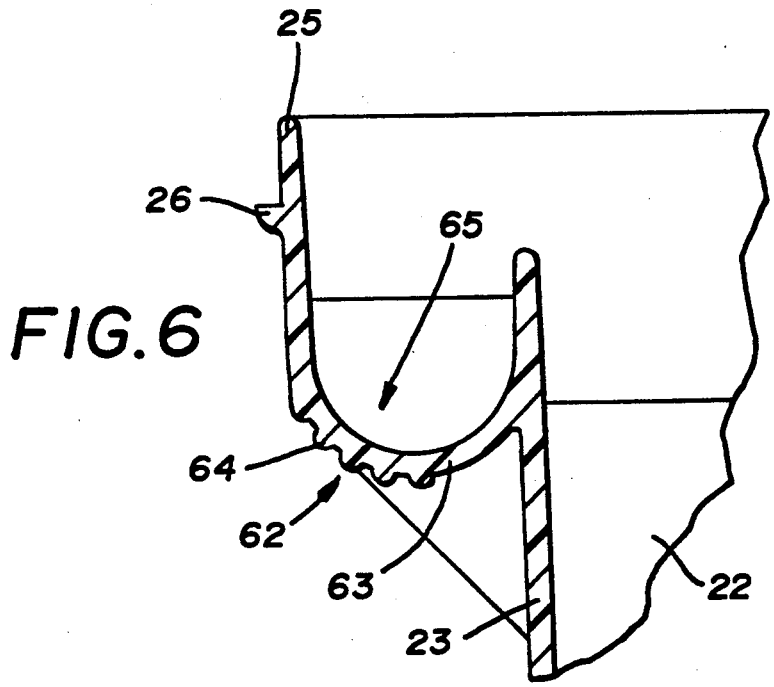
FIG. 6 is a sectional view taken substantially along line 6—6 of FIG. 3 and showing the details of a side handle.

The front surface of toolbox 10 is also provided with a recessed lock receiving area generally indicated by the numeral 51. The recessed nature of lock receiving area 51 is established by interrupting arcuate cover skirt 17, as at 52, and interrupting arcuate base portion skirt 27, as at 53. As such, as best shown in FIG. 5, at the location of lock receiving area 51, the front surface of cover 11 includes a generally vertical wall 54 downwardly directed from top surface 14. The front surface of base portion 13 includes a generally vertical wall 55. A portion 56 of downturned lip 19 of cover 11 is not, however, interrupted and portion 56 extends across and otherwise spans lock receiving area leaving an aperture 57 between portion 56 and wall 54. Likewise, a loop member 58 extends outwardly from the top of front wall 21 of base portion 13 forming an aperture 59 between loop member 58 and wall 55. A padlock or other locking device can thereby be positioned through apertures 57 and 59 to secure toolbox 10.

Figure 2:
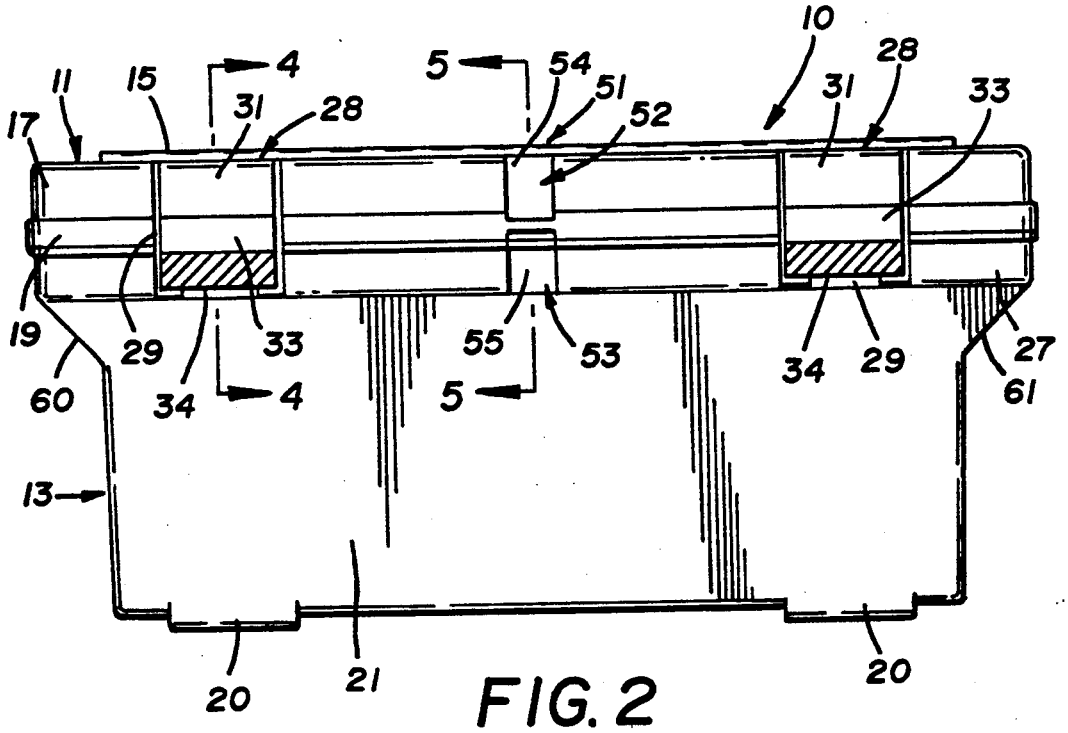
FIG. 2 is a front elevational view of the toolbox of FIG. 1.
Figure 3:
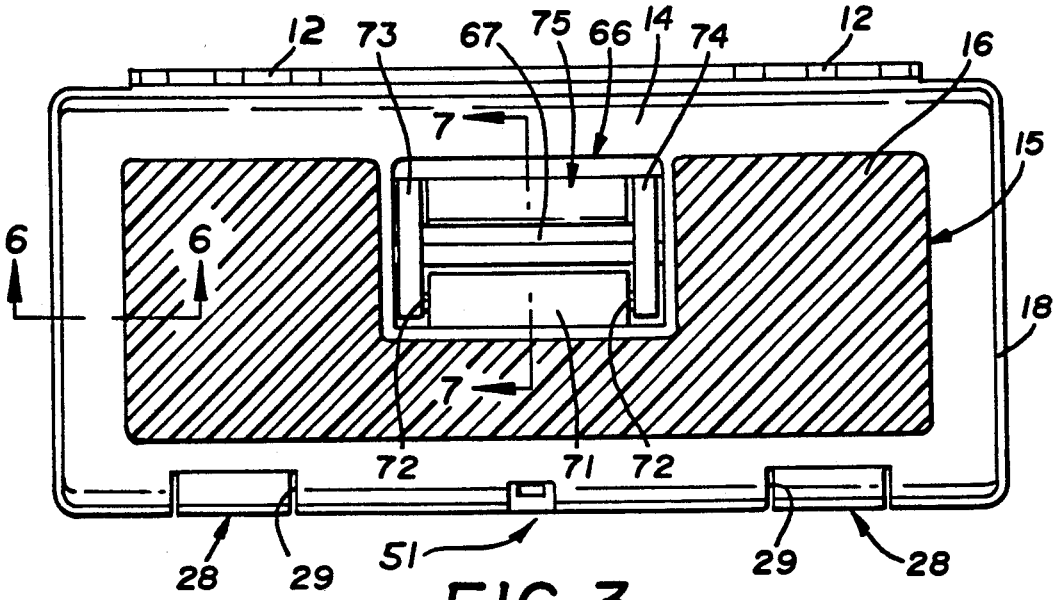
FIG. 3 is a top plan view of the toolbox of FIG. 1.

As shown in FIGS. 1 and 2, side walls 23 and 24 of base portion 13 veer outwardly near the top thereof as at 60 and 61, respectively. As such, cover 11 and the upper portion of base portion 13, such as skirt 27, overhang the vertical sidewalls 23 and 24. It is in this overhang area that recessed side handles, generally indicated by the numeral 62 in FIG. 6, can be formed. Side handles 62 are formed by providing a U-shaped channel 63 in sidewalls 23 and 24 between the vertical portion of walls 23 and 24 and the upper rim 25. Grip assisting ridges 64 may be placed on the outside of channel 63. Handles 62 are thus not only recessed with the attendant advantages previously described, but also valuable internal storage space is not lost, but rather gained, because the inside of handles 63 forms compartments 65 for the storage of small items such as nails, nuts, bolts or the like. Moreover, the arcuate nature of the bottom of compartments 65, being defined by U-shaped channel 63, makes it easy to retrieve such small items, there being no corners or flat surfaces which might entrap such small items or otherwise make them less accessible.

Figure 7:
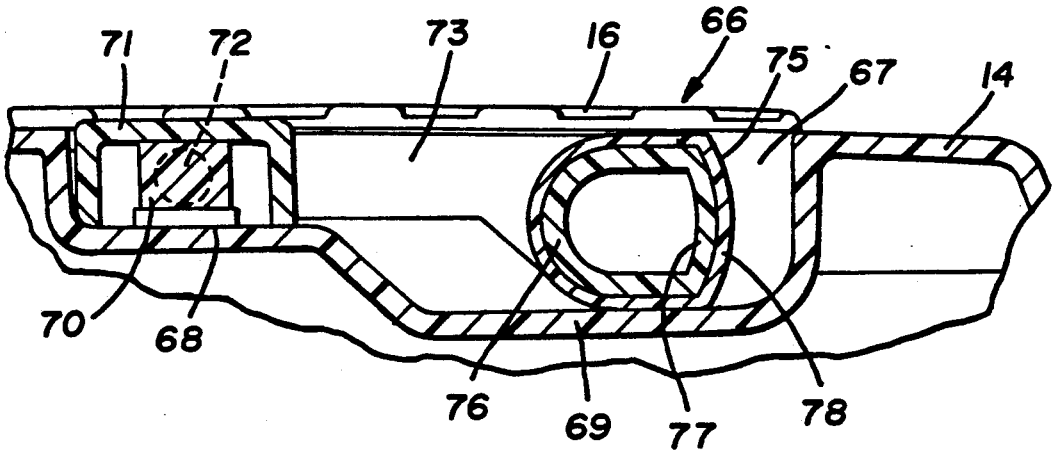
FIG. 7 is a sectional view taken substantially along line 7—7 of FIG. 3 and showing the details of a recessed top handle.

In addition to recessed side handles 62, toolbox 10 may also be provided with a recessed top handle generally indicated by the numeral 66 and shown in detail in FIG. 7. Top handle 66, when in a stored, inoperative position, is provided in a recess 67 in top surface 14. Recess 67 is shown as being positioned between the branches of U-shaped platform 15 and includes a stepped bottom surface having an upper level surface 68 and a lower level surface 69. A bearing block 70 is positioned on upper level surface 68 and is held in place by a U-shaped channel retainer 71 which can be riveted or otherwise attached to upper level surface 68. Bearing block 70 carries a pivot pin 72 which extends laterally outwardly thereof and is connected at each end to one end of handle arms 73 and 74.

A handle grip, generally indicated by the numeral 75, extends between and is carried by the other ends of handle arms 73 and 74 and includes a core consisting of a U-shaped base portion 76 and an arcuate top portion 77 spanning the branches of the U-shaped base portion 76. Base portion 76 and top portion 77 can be molded of the same rigid plastic material as is preferred for the entire toolbox 10, such as polypropylene. In order to pad handle grip 75 and otherwise provide a comfortable, non-slip gripping surface, a soft pad 78 is molded around the entire surface of base portion 76 and top portion 77 of the grip core. A suitable material for handle pad 78 is a product sold under the trade name of Santoprene by Monsanto Chemical Company which is a thermoplastic rubber which, when molded around the polypropylene portion of handle grip 75, chemically bonds to it thereby eliminating the need for any mechanical fastener or adhesive.

It should be noted that arms 73 and 74 are off center with respect to the center of U-shaped base portion 76 of handle grip 75. This permits handle 66 to be totally recessed and flush with top 14 of cover 11 when handle 66 is in the stored position shown in FIG. 7. As such, handle grip 75 rests on the lower level surface 69 of recess 67 and the pivot point of handle 66, as defined by pin 72, is in a plane above both the center of U-shaped base portion 76 of handle grip 75 and lower level surface 69 of recess 67. This also provides additional space for the user to place his fingers around U-shaped base portion 76, as cushioned by pad 78, and conveniently pivot the handle on pin 72 to the upright position to transport toolbox 10.

It should thus be appreciated that the toolbox described herein has all normally externally protruding items, such as latches, handles and the like, recessed thereby substantially improving the art and otherwise accomplishing the objects of the present invention.

We claim:

1. A utility box comprising a base portion forming a container with an open top, a cover portion hingedly attached to said base portion and having a top surface, said base portion and said cover portion having complementary mating surfaces, latch means recessed within and being flush with said mating surfaces to hold said cover portion closed on said base portion, a lock receiving area recessed within said mating surfaces, side handle means formed in said base portion and recessed beneath said cover portion, and top handle means recessed within said top surface of said cover portion.

2. A utility box according to claim 1 wherein said complementary mating surfaces include a first arcuate skirt downwardly directed from said top surface of said cover portion and a second arcuate skirt near the top of said base portion.

3. A utility box according to claim 2 wherein said first and second arcuate skirts are interrupted to form a recess for said locking receiving area and further comprising means extending across said interruption in said first arcuate skirt and forming a first aperture, means extending across said interruption in said second arcuate skirt and forming a second aperture, said first and second apertures being aligned when said cover portion is closed on said base portion so that a lock may be received therethrough.

4. A utility box according to claim 2 wherein said latch means is recessed within said first and second arcuate surfaces and includes a latch handle having an upper arcuate surface complementary to and flush with said first arcuate surface and a lower arcuate surface complementary to and flush with said second arcuate surface.

5. A utility box according to claim 1 wherein said side handle means include a U-shaped channel formed near the top of said base portion, said U-shaped channel being open on the top within said base member to form a compartment for materials stored therein.

6. A utility box according to claim 1 wherein said top surface of said cover portion is generally flat and includes a recess for receiving said top handle means.

7. A utility box according to claim 6 wherein said top handle means includes a grip member, said grip member having a core of a rigid material and a cushioning material around said core to provide comfortable gripping of said grip member.

8. A utility box according to claim 7, said top handle means further including means to permit rotation of said grip member from a position within said recess to an upright position outside of said recess.

9. A utility box comprising a base portion forming a container with an open top, a cover portion hingedly attached to said base portion, said cover portion having a downwardly directed skirt, said base portion having a skirt near the top thereof, and means to latch said cover portion to said base portion, said means to latch including a latch handle having an exterior configuration with a first surface complementary to said downwardly directed skirt of said cover portion and a second surface complementary to said skirt of said base portion, said first and second surfaces of said latch handle being flush with said downwardly directed skirt of said cover portion and said skirt of said base portion, respectively, when said means to latch is holding said cover portion closed on said base portion.

10. A utility box according to claim 9 wherein said downwardly directed skirt of said cover portion and said skirt of said base portion are provided with a recess, said means to latch being positioned in said recess.

11. A utility box according to claim 9 wherein said means to latch includes means to pivot said latch handle from a position holding said cover portion closed on said base portion to an open position away from said cover portion and said base portion.

12. A utility box according to claim 11 wherein said cover portion includes a locking notch generally above said downwardly directed skirt, said latch handle including a locking lug near the top thereof to engage said notch when said means to latch is holding said cover portion closed on said base portion.

13. A utility box according to claim 9 wherein said cover portion includes a lip extending downwardly from said downwardly directed skirt and positioned between said downwardly directed skirt of said cover portion and said skirt of said base portion when said cover portion is closed on said base portion.

14. A utility box according to claim 13 wherein the exterior configuration of said latch handle includes a third surface between said first and second surfaces, said third surface being complementary to the configuration of said lip.

15. A utility box according to claim 9 wherein said means to latch includes first pivot means carried by said base portion, second pivot means on said latch handle, and means to link said first pivot means and said second pivot means so that said latch handle may be pivoted from a position holding said cover portion closed on said base portion to an open position away from said cover portion and said base portion.

16. A utility box according to claim 15 wherein said first pivot means includes a trunnion carried by said base portion and a tubular bearing member carried by said trunnion.

17. A utility box according to claim 16 wherein said second pivot means includes a tubular bearing member carried by said latch handle and pin means supported by said base portion and received within said bearing member so that said latch handle can pivot relative to said base portion.

18. A utility box according to claim 17 wherein said means to link extends between said bearing member carried by said trunnion and said bearing member carried by said latch handle.

19. A utility box according to claim 18 wherein said means to link carries a pivot pin, said bearing member carried by said trunnion having a key slot to receive said pivot pin.

20. A utility box comprising a base portion forming a container with an open top, a cover hingedly attached to said base portion, said cover portion having a downwardly directed skirt, said base portion having a skirt near the top thereof, said skirts being interrupted to form a recess therein, and means in said recess for receiving a lock to hold said cover portion on said base portion and secure the contents

21. A utility box according to claim 20 wherein said means in said recess includes means extending across the interruption of said downwardly directed skirt of said cover portion and forming an aperture.

22. A utility box according to claim 21 wherein said means in said recess includes means extending across the interruption of said skirt of said base portion and forming a second aperture, said aperture and said second aperture being aligned when said cover portion is closed on said base portion so that the lock may be received therethrough.

* * * * *

UNITED STATES PATENT AND TRADEMARK OFFICE

CERTIFICATE OF CORRECTION

PATENT NO. : B2 5,193,706

DATED : February 25, 1997

INVENTOR(S) : Hanna et al.

It is certified that error appears in the above-identified patent and that said Letters Patent is hereby corrected as shown below:

Claim 3, column 1, line 38, delete the letters "fl" at the end of line 38 and add "flush with said mating surfaces to hold said cover portion closed on said base portion, a lock receiving area recessed within said mating surfaces, side handle means formed in said base portion and recessed beneath said cover portion, and top handle means recessed within said top surface of said cover portion, wherein said first and second arcuate skirts are interrupted to form a recess for said [locking] lock receiving area and further comprising means extending across said interruption in said first arcuate skirt and forming a first aperture, means extending across said interruption in said second arcuate skirt and forming a second aperture, said first and second apertures being aligned when said cover portion is closed on said base portion so that a lock may be received therethrough."

Claim 5, column 2, line 3, delete the letters "mea" at the end of line 3 and add "means formed in said base portion and recessed beneath said cover portion, and top handle means recessed within said top surface of said cover portion, wherein said side handle means include a U-shaped channel formed near the top of said base portion, said U-shaped channel being open on the top within said base [member] portion to form a compartment for materials stored therein."

Signed and Sealed this

Fifth Day of January, 1999

*Attest:*

*Attesting Officer*

*Acting Commissioner of Patents and Trademarks*

US005193706A

REEXAMINATION CERTIFICATE (2515th)

United States Patent [19]

[11] B1 5,193,706

Hanna et al.

[45] Certificate Issued Mar. 28, 1995

[54] TOOL BOX

[75] Inventors: Thomas E. Hanna; Keith E. Brightbill, both of Wooster, Ohio

[73] Assignee: Rubbermaid Incorporated, Wooster, Ohio

Reexamination Request:
No. 90/003,372, Mar. 28, 1994

Reexamination Certificate for:

| | |
|---|---|
| Patent No.: | **5,193,706** |
| Issued: | **Mar. 16, 1993** |
| Appl. No.: | **471,285** |
| Filed: | **Jan. 26, 1990** |

[51] Int. Cl.[6] ..... B65D 45/16

[52] U.S. Cl. ..... 220/324; 220/315; 220/334; 220/756; 220/761; 220/771; 220/772; 292/113; 292/DIG. 38; 292/DIG. 49; 312/902

[58] Field of Search ..... 220/315, 324, 326, 334, 220/335, 337, 338, 342, 343, 344, 753, 755, 756, 761, 766, 767, 768, 769, 771, 772; 150/155; 190/115; 292/113, DIG. 38, DIG. 49; 312/244, 902

[56] References Cited

U.S. PATENT DOCUMENTS

| | | | |
|---|---|---|---|
| D. 158,368 | 5/1950 | Felts et al. | D58/12.6 |
| D. 220,556 | 4/1971 | Evans | D87/1 |
| D. 232,129 | 7/1974 | Evans | D87/1 R |
| D. 237,121 | 10/1975 | Metzner | D87/1 |
| D. 246,071 | 10/1977 | Landell et al. | D87/1 R |
| D. 246,139 | 10/1977 | Landell et al. | D87/1 R |
| D. 246,548 | 11/1977 | Uyeda | D87/1 R |
| 2,893,771 | 7/1959 | Claud-Mantle et al. | 292/113 |
| 3,181,905 | 5/1965 | Bisbing | 292/109 |
| 3,346,733 | 10/1967 | Woolworth | 240/6.4 |
| 3,362,561 | 1/1968 | Bakos . | |
| 3.466,076 | 9/1969 | Bisbing | 292/109 |
| 3,490,805 | 1/1970 | Di Pierro et al. | 292/258 |
| 3,606,511 | 9/1971 | Henning et al. | 312/266 |
| 3,628,843 | 12/1971 | Wynne et al. | 312/294 |
| 3,747,796 | 7/1973 | Kneier et al. . | |
| 3,822,905 | 7/1974 | Bell | 292/87 |
| 3,985,409 | 10/1976 | Kneier | 312/271 |
| 4,023,840 | 5/1977 | Souza et al. | 292/113 |
| 4,161,261 | 7/1979 | Frater | 220/337 |
| 4,244,612 | 1/1981 | Schurman | 292/249 |
| 4,261,078 | 4/1981 | Edwards et al. | 16/126 |
| 4,474,291 | 10/1984 | Fortson | 206/315.11 |
| 4,501,378 | 2/1985 | Berfield | 220/324 |
| 4,502,715 | 3/1985 | Lundblade | 292/78 |
| 4,540,206 | 9/1985 | Frame et al. | 292/66 |
| 4,544,050 | 10/1985 | Seynhaeve | 190/115 |
| 4,662,515 | 5/1987 | Newby, Sr. | 206/349 |
| 4,665,596 | 5/1987 | Green | 24/662 |
| 4,705,308 | 11/1987 | Bisbing | 292/108 |
| 4,729,474 | 3/1988 | Lanius et al. | 206/315.11 |
| 4,739,577 | 4/1988 | Lanius | 43/54.1 |
| 4,775,199 | 10/1988 | Lanius et al. | 312/220 |
| 4,828,298 | 5/1989 | Bisbing | 292/113 |
| 5,012,553 | 5/1991 | Hardigg et al. | 16/126 |

FOREIGN PATENT DOCUMENTS

| | | |
|---|---|---|
| 0221215A1 | 10/1985 | European Pat. Off. . |
| 2565205 | 12/1985 | France . |
| 603995 | 6/1948 | United Kingdom . |
| 2200617A | 1/1988 | United Kingdom . |

OTHER PUBLICATIONS

Plano catalog, 1989, Plano Molding Company, 431 E. South Street, P.O. Box 189, Plano, Ill. 60545-0189.

Flambeau catalog, 1989, Flambeau Products Corporation, Hardware Division, 15981 Valplast Rd., Middlefield, Ohio 44062.

Contico catalog, 1989, Contico, St. Louis, Mo. 63132.

Disston brochure, 1989, The Disston Company, P.O. Box 3000, Danville, Va. 24543.

MTM Tool Gard Brochure, MTM Molded Products Company, P.O. Box 14117, Dayton, Ohio 45414.

GSC brochure, GSC Technology Corporation, Champlain, N.Y.

Ecko catalog, 1989, Ecko Specialty Products, 165 W. Chicago Avenue, Chicago, Ill. 60610.

*Primary Examiner*—Allan N. Shoap

[57] ABSTRACT

A utility box (10) includes a base portion (13) and a cover portion (11) attached thereto as by hinges (12). The cover portion (11) includes a downwardly directed

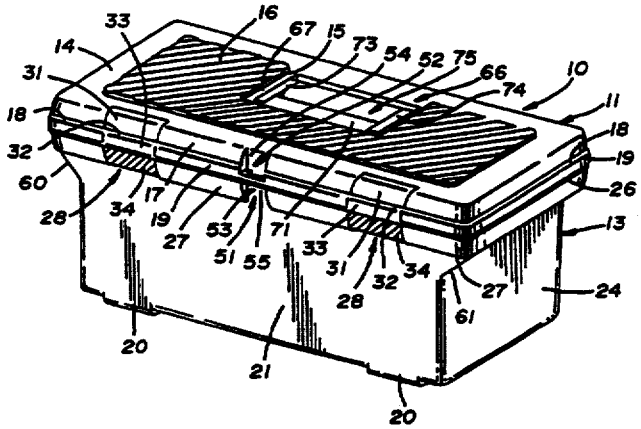

skirt (17) and the upper end of the base portion (13) is provided with a complementary skirt (27). At least one latch assembly (28) is recessed within the complementary skirts (17, 27) and includes a latch handle (30) having an outer contour matching the complementary skirts (17, 27). A lock receiving area (52) is also recessed within the complementary skirts (17, 27). Side handles (62) are formed in the base portion (13) and recessed beneath the cover portion (11). A top handle (66) is provided within a recess (67) in the top surface (14) of cover portion (11).

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–8 10–19 and 22 is confirmed.

Claims 9, 20 and 21 are cancelled.

* * * * *

US005193706B1

REEXAMINATION CERTIFICATE (3138th)

United States Patent [19] [11] B2 5,193,706

Hanna et al. [45] Certificate Issued Feb. 25, 1997

[54] TOOLBOX

[75] Inventors: Thomas E. Hanna; Keith E. Brightbill, both of Wooster, Ohio

[73] Assignee: Rubbermaid Incorporated, Wooster, Ohio

Reexamination Request:
No. 90/003,730, Feb. 23, 1995

Reexamination Certificate for:

| | |
|---|---|
| Patent No.: | **5,193,706** |
| Issued: | **Mar. 16, 1993** |
| Appl. No.: | **471,285** |
| Filed: | **Jan. 26, 1990** |

[51] Int. Cl.[6] ..... B65D 45/16

[52] U.S. Cl. ..... 220/324; 220/315; 220/334; 220/756; 220/761; 220/771; 220/772; 292/113; 292/DIG. 38; 292/DIG. 39; 292/DIG. 49; 312/902

[58] Field of Search ..... 220/315, 324, 220/326, 334, 335, 337, 338, 342, 343, 344, 753, 755, 756, 761, 766, 767, 768, 769, 771, 772; 150/155; 190/115; 292/113, DIG. 38, DIG. 49; 312/244, 902

[56] References Cited

U.S. PATENT DOCUMENTS

| | | |
|---|---|---|
| D. 297,809 | 9/1988 | Castelli et al. . |
| 4,261,078 | 4/1981 | Edwards et al. . |
| 4,662,515 | 5/1987 | Newby, Sr. . |
| 5,004,103 | 4/1991 | Connors et al. . |
| 5,111,920 | 5/1992 | Castelli et al. . |

FOREIGN PATENT DOCUMENTS

| | | |
|---|---|---|
| 2253024 | 7/1973 | Germany . |

*Primary Examiner*—Stephen Cronin

[57] ABSTRACT

A utility box (10) includes a base portion (13) and a cover portion (11) attached thereto as by hinges (12). The cover portion (11) includes a downwardly directed skirt (17) and the upper end of the base portion (13) is provided with a complementary skirt (27). At least one latch assembly (28) is recessed within the complementary skirts (17, 27) and includes a latch handle (30) having an outer contour matching the complementary skirts (17, 27). A lock receiving area (52) is also recessed within the complementary skirts (17, 27). Side handles (62) are formed in the base portion (13) and recessed beneath the cover portion (11). A top handle (66) is provided within a recess (67) in the top surface (14) of cover portion (11).

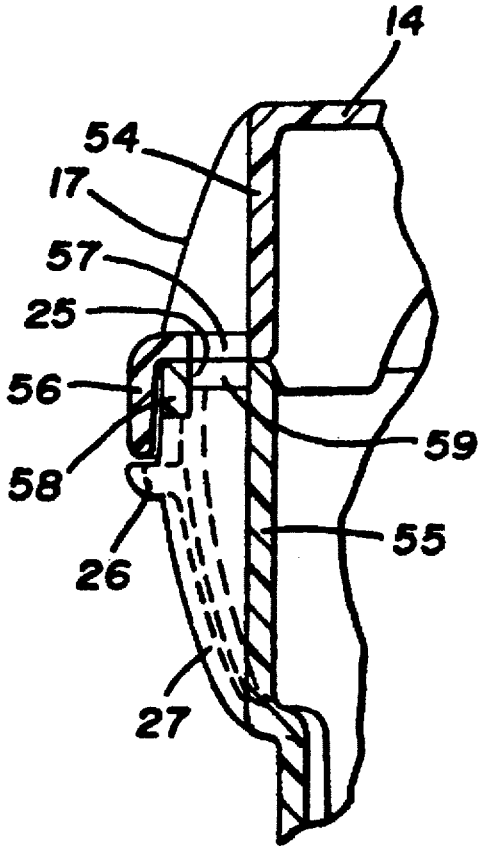

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 9, 20 and 21 were previously cancelled.

Claims 1 and 22 are cancelled.

Claims 2, 3, 5, 6, 10, 11, 13, 14 and 15 are determined to be patentable as amended.

Claims 4, 7, 8, 12, 16, 17, 18 and 19, dependent on an amended claim, are determined to be patentable.

2. A utility box according to claim [1] *5* wherein said complementary mating surfaces include a first arcuate skirt downwardly directed from said top surface of said cover portion and a second arcuate skirt near the top of said base portion.

3. A utility box [according to claim 2] *comprising a base portion forming a container with an open top, a cover portion hingedly attached to said base portion and having a top surface, said base portion and said cover portion having complementary mating surfaces which include a first arcuate skirt downwardly directed from said top surface of said cover portion and a second arcuate skirt near the top of said base portion, latch means recessed within and being fl*

5. A utility box [according to claim 1] *comprising a base portion forming a container with an open top, a cover portion hingedly attached to said base portion and having a top surface, said base portion and said cover portion having complementary mating surfaces, latch means recessed within and being flush with said mating surfaces to hold said cover portion closed on said base portion, a lock receiving area recessed within said mating surfaces, side handle mea*

6. A utility box according to claim [1] *5* wherein said top surface of said cover portion is generally flat and includes a recess for receiving said top handle means.

10. A utility box according to claim [9] *13* wherein said downwardly directed skirt of said cover portion and said skirt of said base portion are provided with a recess, said means to latch being positioned in said recess.

11. A utility box according to claim [9] *13* wherein said means to latch includes means to pivot said latch handle from a position holding said cover portion closed on said base portion to an open position away from said cover portion and said base portion.

13. A utility box according to claim 9 wherein said cover portion includes a lip extending downwardly from said downwardly directed skirt and [positioned between said downwardly directed skirt of said cover portion and] *in contact with* said skirt of said base portion when said cover portion is closed on said base portion, *said lip being unitarily formed as a one-piece part of said skirt of said cover portion.*

14. A utility box according to claim 13 wherein the exterior configuration of said latch handle includes a third surface between said first and second surfaces, said third surface being complementary to the configuration of *and flush with* said lip.

15. A utility box according to claim [9] *13* wherein said means to latch includes first pivot means carried by said base portion, second pivot means on said latch handle, and means to link said first pivot means and said second pivot means so that said latch handle may be pivoted from a position holding said cover portion closed on said base portion to a open position away from said cover portion and said base portion.

* * * * *